US009532653B2

(12) United States Patent
Green et al.

(10) Patent No.: US 9,532,653 B2
(45) Date of Patent: Jan. 3, 2017

(54) ADJUSTABLE CHAIRS AND RELATED METHODS

(71) Applicants: Kurt R. Green, Minneapolis, MN (US); Kyle E. Green, Burlington, KY (US)

(72) Inventors: Kurt R. Green, Minneapolis, MN (US); Kyle E. Green, Burlington, KY (US)

(73) Assignee: Green Industries LLC, Burlington, KY (US)

( * ) Notice: Subject to any disclaimer, the term of this patent is extended or adjusted under 35 U.S.C. 154(b) by 0 days.

(21) Appl. No.: 14/711,296

(22) Filed: May 13, 2015

(65) Prior Publication Data

US 2015/0327682 A1 Nov. 19, 2015

Related U.S. Application Data

(60) Provisional application No. 61/992,663, filed on May 13, 2014.

(51) Int. Cl.

| | |
|---|---|
| ***A47C 4/28*** | (2006.01) |
| ***A47C 7/00*** | (2006.01) |
| ***A47C 9/10*** | (2006.01) |

(52) U.S. Cl.

CPC *A47C 7/008* (2013.01); *A47C 9/10* (2013.01)

(58) Field of Classification Search

CPC ..... A47C 9/10; A47C 7/008
USPC ..... 297/45, 357
See application file for complete search history.

(56) References Cited

U.S. PATENT DOCUMENTS

| | | | | |
|---|---|---|---|---|
| 2,905,513 | A * | 9/1959 | Kane | A47B 3/00 108/128 |
| 4,772,068 | A * | 9/1988 | Gleckler | A47C 7/002 297/39 X |
| 5,364,163 | A | 11/1994 | Hardison | |
| 5,494,333 | A | 2/1996 | Wilson | |
| 5,499,856 | A * | 3/1996 | Sorrell | A61H 3/04 297/35 X |
| 6,820,928 | B1 * | 11/2004 | Ransom | A47C 4/10 297/29 X |
| 6,871,911 | B2 * | 3/2005 | Alexander, Jr. | A47C 3/36 297/46 X |
| 6,905,172 | B1 * | 6/2005 | Barnett | A47C 7/002 248/188.5 |
| 7,147,277 | B1 * | 12/2006 | Miller | A47C 1/0265 297/16.1 |
| 7,328,951 | B2 | 2/2008 | Ward et al. | |

(Continued)

*Primary Examiner* — Rodney B White
(74) *Attorney, Agent, or Firm* — Wood Herron & Evans LLP

(57) ABSTRACT

An adjustable chair includes an upper frame configured to carry a seat, and a lower frame pivotably coupled with the upper frame and configured to support the upper frame above a ground surface. The adjustable chair further includes an adjustment mechanism that is selectively movable between a plurality of positions for securing the upper frame relative to the lower frame in a corresponding plurality of orientations. A method of adjusting an adjustable chair including a first chair portion carrying a seat and a second chair portion includes providing the first chair portion and the seat in a first orientation relative to the second chair portion. The first chair portion is pivoted about a first pivot axis to provide the first chair portion and the seat in a second orientation relative to the second chair portion.

21 Claims, 6 Drawing Sheets

(56) References Cited

U.S. PATENT DOCUMENTS

| | | | | |
|---|---|---|---|---|
| 8,465,090 | B1 * | 6/2013 | O'Connor | A47C 7/62<br>297/45 X |
| 8,517,462 | B2 * | 8/2013 | Birch | A01M 31/02<br>297/17 X |
| 8,960,784 | B1 * | 2/2015 | De Berry | A47C 7/008<br>297/53 X |
| 9,282,822 | B2 * | 3/2016 | Hogue | A47C 1/026 |
| 9,314,100 | B1 * | 4/2016 | Logan | A47C 1/14 |
| 2007/0145792 | A1 * | 6/2007 | Miller | A47C 1/0265<br>297/184.1 |
| 2013/0026799 | A1 * | 1/2013 | Miller | A47C 4/46<br>297/19 |

* cited by examiner

ADJUSTABLE CHAIRS AND RELATED METHODS

CROSS-REFERENCE TO RELATED APPLICATION

This application claims the priority of Provisional Application Ser. No. 61/992,663, filed May 13, 2014, the disclosure of which is hereby incorporated by reference herein.

TECHNICAL FIELD

The present invention relates generally to chairs, and more specifically, to adjustable chairs.

BACKGROUND

Chairs are convenient tools for sitting and relaxing. It is generally well known to use chairs inside building structures, such as homes, and on flat surfaces, such as patios. It is also known to take chairs to other locations such as ball fields, beaches, parks, and the like. Most chairs are designed to be used on flat surfaces, however, and do not perform well on sloped surfaces. In particular, chairs can be unstable on sloped surfaces and can present challenges for an individual attempting to sit on the chair on a sloped surface. For example, a hunter may select a spot from which to hunt on a hillside, and might wish to sit on a chair. Also, a fisherman might sit on the bank of a lake or river, which could be sloped, and might also wish to sit on a chair.

Therefore a need exists for improvements relating to chairs for sitting on sloped surfaces.

SUMMARY

In accordance with an exemplary embodiment, an adjustable chair includes an upper frame configured to carry a seat, and a lower frame pivotably coupled with the upper frame and configured to support the upper frame above a ground surface. The adjustable chair further includes an adjustment mechanism that is selectively movable between a plurality of positions for securing the upper frame relative to the lower frame in a corresponding plurality of orientations.

In accordance with another exemplary embodiment, a method is provided for adjusting an adjustable chair including a first chair portion carrying a seat, and a second chair portion. The method includes providing the first chair portion and the seat in a first orientation relative to the second chair portion. The method further includes pivoting the first chair portion about a first pivot axis to provide the first chair portion and the seat in a second orientation relative to the second chair portion.

Various additional features and advantages of the invention will become more apparent to those of ordinary skill in the art upon review of the following detailed description of the illustrative embodiments taken in conjunction with the accompanying drawings. The accompanying drawings, which are incorporated in and constitute a part of this specification, illustrate embodiments of the invention and, together with the general description of the invention given above and the detailed description of the embodiments given below, serve to explain the principles of the present invention.

DETAILED DESCRIPTION

Figure 1:
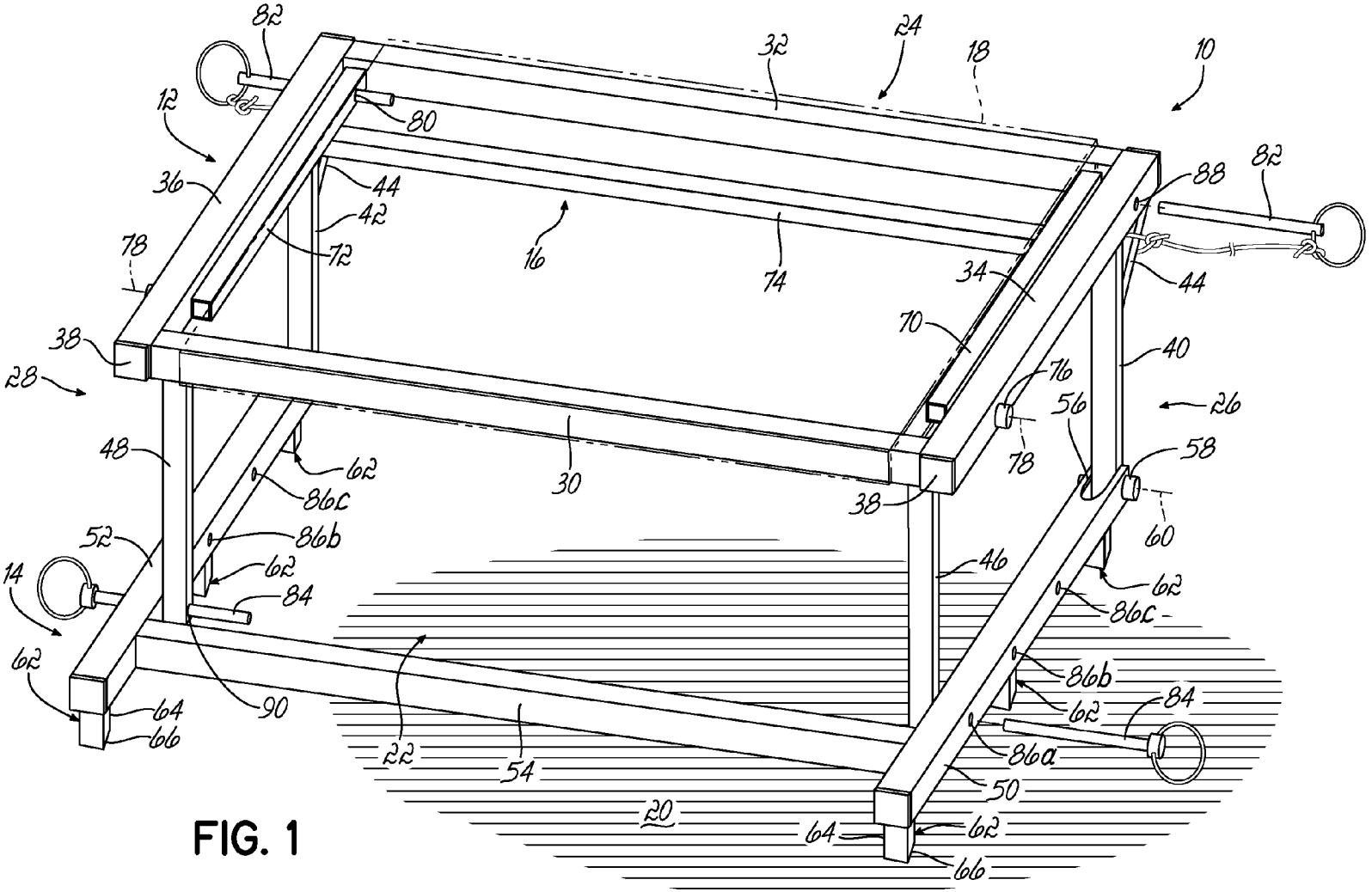
FIG. 1 is a front perspective view of an exemplary first embodiment of an adjustable chair in accordance with the principles of the invention.

Referring to FIGS. 1-4, and beginning with FIG. 1, an adjustable chair 10 according to a first exemplary embodiment of the invention is shown. The adjustable chair 10 generally includes an upper frame 12, a lower frame 14, and an adjustment mechanism shown herein in the form of an adjustment brace 16. The upper frame 12 is configured to carry a seat 18, shown in phantom in FIG. 1 and shown in greater detail in FIG. 4. The lower frame 14 is pivotably coupled with the upper frame 12 and is configured to support the upper frame 12 above a ground surface 20. As described in greater detail below, the adjustment brace 16 is pivotably coupled to the upper frame 12 and is selectively movable between a plurality of positions for securing the upper frame 12 relative to the lower frame 14 in a corresponding plurality of orientations, including a parallel orientation and at least one angular orientation. In this manner, the adjustable chair 10 may be adjusted to provide a comfortable seating position for a user on a flat or sloped ground surface 20. The adjustable chair 10 generally includes a front 22, a rear 24, a left side 26, and a right side 28.

In the embodiment shown, the upper frame 12 generally includes four elongate upper frame members, including a front upper frame member 30, an opposed rear upper frame member 32, a left side upper frame member 34, and an opposed right side upper frame member 36. As shown, the ends of the upper frame members 30, 32, 34, 36 are rigidly coupled to one another so as to define a generally rectangular shape. Accordingly, the front and rear upper frame members 30, 32 are substantially parallel to one another, and the left side and right side upper frame members 34, 36 are substantially parallel to one another. In alternative embodiments, various other upper frame shapes and corresponding quantity and arrangement of upper frame members 30, 32, 34, 36 may be provided.

Each of the upper frame members 30, 32, 34, 36, as well as various other components of the adjustable chair 10 described below, may be formed with a generally square cross-sectional shape. In alternative embodiments, various other cross-sectional shapes may also be used, such as circular for example. Additionally, the upper frame members 30, 32, 34, 36, as well as other structural components of the adjustable chair 10 described below, may be formed of any suitable material or combinations of materials, such as various metals including steel and/or plastic composite materials, for example. The left side and right side upper frame members 34, 36, as well as similar structural components of the adjustable chair 10 described below, may be provided with a protective end cap 38 at one or both of their ends.

The upper frame 12 further includes four downwardly depending legs rigidly coupled to the upper frame members 30, 32, 34, 36. In particular, a left side rear leg 40 depends downwardly from a rear end of the left side upper frame member 34, and an opposed right side rear leg 42 depends downwardly from a rear end of the right side upper frame member 36. Each of the left side and right side rear legs 40, 42 includes an angled gusset member 44 for increased structural rigidity. Additionally, a left side front leg 46 depends downwardly from a left end of the front upper frame member 30, and an opposed right side front leg 48 depends downwardly from a right end of the front upper frame member 30. As shown, each of the downwardly depending legs 40, 42, 46, 48 extends substantially perpendicular to the respective upper frame member 30, 32, 34, 36 from which it depends. Further, the downwardly depending legs 40, 42, 46, 48 may be formed integrally with, or otherwise be rigidly attached to, the respective upper frame member 30, 32, 34, 36.

The lower frame 14 includes a left side lower frame member 50 and an opposed right side lower frame member 52, which extend substantially parallel to one another. A lower frame cross-member 54 extends perpendicularly between the left side and right side lower frame members 50, 52 and is positioned inwardly from the front ends thereof. The lower frame members 50, 52, 54 are rigidly coupled to one another.

The left side lower frame member 50 is pivotably coupled to the left side rear leg 40 of the upper frame 12, and the right side lower frame member 52 is pivotably coupled to the right side rear leg 42 of the upper frame 12. The rear end of each of the left side and right side lower frame members 50, 52 includes a longitudinally extending channel 56 and a lower pivot pin 58 extending laterally through the channel 56. The lower pivot pins 58 define a laterally extending frame pivot axis 60. The left side and right side rear legs 40, 42 of the upper frame 12 are pivotably coupled to the lower pivot pins 58 of the left side and right side lower frame members 50, 52, respectively, such that the upper frame 12 may pivot relative to the lower frame 14 about the frame pivot axis 60.

The lower frame 14 further includes a plurality of spike members 62 configured to pierce and thereby engage the ground surface 20 for releasably anchoring the adjustable chair 10 to the ground surface. The spike members 62 are coupled to and extend downwardly from the left side and right side lower frame members 50, 52. In the illustrated embodiment, each of the left side and right side lower frame members 50, 52 includes three spike members 62 spaced generally equidistant from one another. It will be appreciated that any suitable quantity of spike members 62 may alternatively be provided, arranged with any suitable spacing. Each spike member 62 generally includes a shaft portion 64 and a beveled portion 66 configured to pierce the ground surface 20. As shown, the beveled portion 66 may be oriented toward the front 22 of the adjustable chair 10.

The adjustment brace 16 includes a left brace arm 70 and an opposed right brace arm 72 extending parallel to one another. A brace cross-member 74 extends perpendicularly between the left and right brace arms 70, 72 and is positioned inwardly from the rear ends thereof, which correspond to the rear 24 of the adjustable chair 10. Various alternative constructions of the adjustment brace 16 may also be provided. The left brace arm 70 and right brace arm 72 are pivotably coupled to the left side upper frame member 34 and the right side upper frame member 36, respectively, via upper pivot pins 76. The upper pivot pins 76 define a laterally extending brace pivot axis 78 about which the adjustment brace 16 pivots relative to the upper frame 14.

The adjustment brace 16 is selectively pivotable about the brace pivot axis 78 between a plurality of positions in which the adjustment brace 16 may be releasably coupled to the upper frame 12 or the lower frame 14, for securing the upper frame 12 relative to the lower frame 14 in a corresponding plurality of orientations. As described below in connection with the exemplary embodiment shown herein, such orientations may include a parallel orientation and at least one angular orientation. The rear end of each of the brace arms 70, 72 includes a brace aperture 80 extending laterally therethrough and sized to receive one of an upper retention pin 82 or a lower retention pin 84 for securing the adjustment brace 16 in the plurality of positions. As shown, any one of the retention pins 82, 84 may be tethered to the respective upper frame 12 or lower frame 14.

Each of the left side and right side lower frame members 50, 52 includes a plurality of lower frame apertures 86*a*, 86*b*, and 86*c*, which is aligned with the corresponding plurality of apertures 86*a*, 86*b*, and 86*c* provided on the opposed lower frame member 50, 52. Each pair of lower frame apertures 86*a*, 86*b*, and 86*c* defines a position at which the adjustment brace 16 may be releasably coupled to the lower frame 14, using the lower retention pins 84, for providing the upper frame 12 with a corresponding orientation relative to the lower frame 14. Accordingly, the quantity of lower frame apertures determines the quantity of orientations in which the upper frame 12 may be secured relative to the lower frame 14. In the embodiment shown, the lower frame members 50, 52 include three sets of lower frame apertures 86*a*, 86*b*, and 86*c*, spaced generally equidistant from one another. This configuration allows for three positions in which the adjustment brace 16 may be releasably coupled to the lower frame 14, and a total of four possible frame orientations, as described below.

The positioning and relative spacing of the lower frame apertures 86*a*, 86*b*, 86*c* on the lower frame members 50, 52 determines the frame angle defined between the upper frame 12, and thus the seat 18, and the lower frame 14 when the adjustment brace 16 is secured to the lower frame 14 at any given position. In alternative embodiments, any suitable quantity, positioning, and relative spacing of lower frame apertures may be provided to enable any desired quantity and arrangement of frame orientations when releasably coupling the adjustment brace 16 to the lower frame 14.

Figure 2:
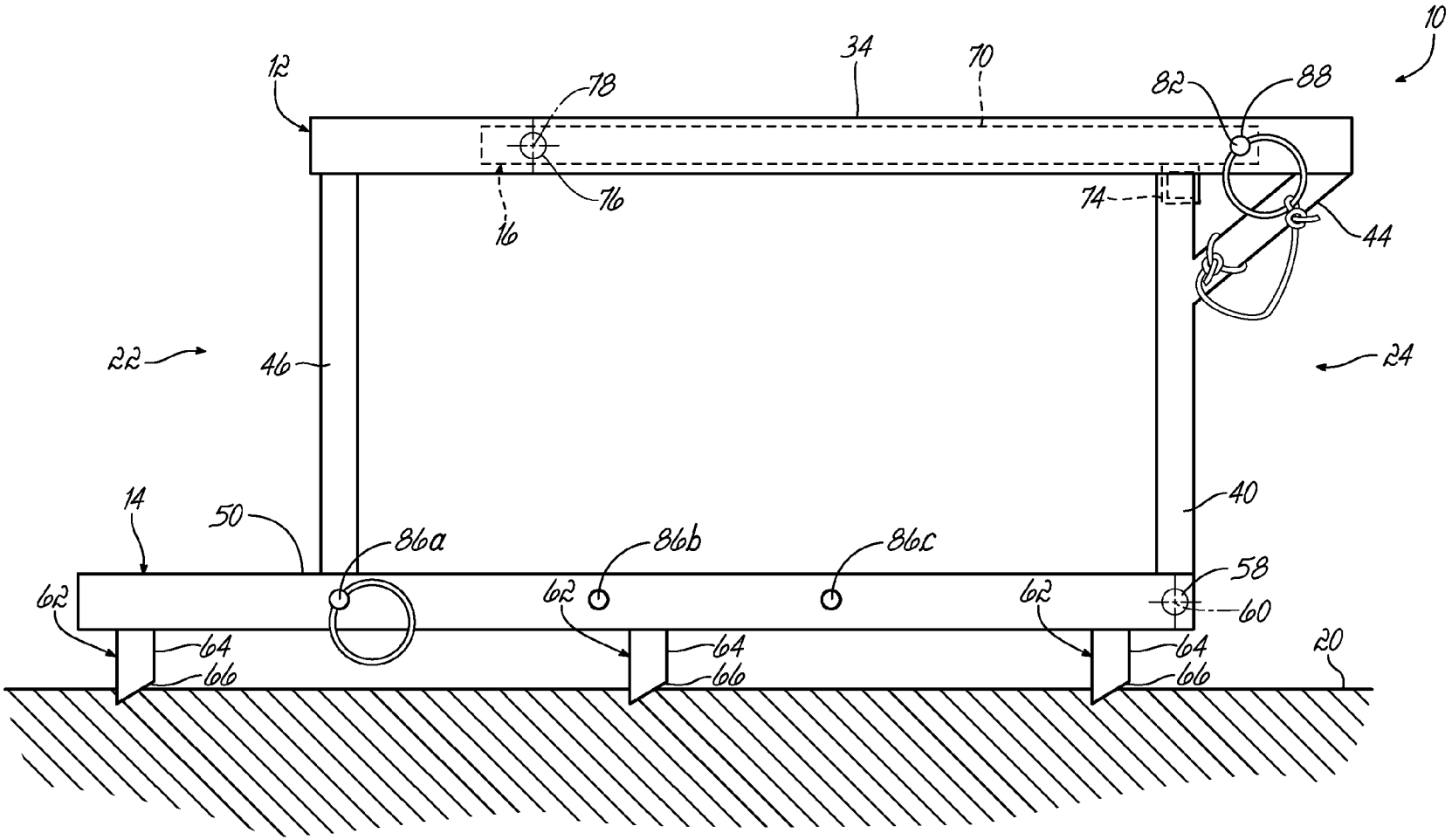
FIG. 2 is a left side view of the adjustable chair of FIG. 1, showing an adjustment mechanism of the chair in a first position.

FIGS. 1 and 2 show the adjustment brace 16 in a first position in which the upper frame 12 is substantially parallel to the lower frame 14, for use when the adjustable chair 10 is positioned on a horizontal ground surface 20, for example. As shown in the illustrated embodiment, in the first position the adjustment brace 16 is not coupled to the lower frame 14 but rather only to the upper frame 12. In particular, in the first position, the brace apertures 80 are aligned with respective upper frame apertures 88 formed on the rear ends of the left side and right side upper frame members 34, 36. Upper retention pins 82 are then inserted through the aligned upper frame apertures 88 and brace apertures 80, thereby securing the adjustment brace 16 substantially in a plane defined by the upper frame 12.

In order to releasably secure the upper frame 12 to the lower frame 14 while the adjustment brace 16 is in the first position, the left side and right side front legs 46, 48 are releasably secured to the left side and right side lower frame members 50, 52, respectively. In particular, a leg aperture 90 formed in a lower end of each of the left side and right side front legs 46, 48 is aligned with the front-most lower frame aperture 86*a* formed on the respective lower frame member 50, 52. A lower retention pin 84 is then inserted through the aligned apertures 86*a*, 90 to establish the releasable coupling. Accordingly, when a user sits on the seat 18, the weight force exerted by the user is transferred from the seat to the upper frame 12, and from the upper frame 12 to the lower frame 14 through the left side and right side front legs 46, 48 and through the left side and right side rear legs 40, 42.

The adjustment brace 16 may be selectively pivoted about the brace pivot axis 78 and releasably coupled to the lower frame 14 in one or more second positions in which the upper frame 12 is positively angled relative to the lower frame 14, for use on a sloped ground surface 20 for example. Each of the one or more second positions is defined by a corresponding pair of the lower frame apertures 86*a*, 86*b*, 86*c*, with which the brace apertures 80 are aligned for coupling the adjustment brace 16 to the lower frame 14 with the lower retention pins 84. Each of the one or more second positions defines a unique angle between upper frame 12, and thus the seat 18, and the lower frame 14. Accordingly, when the adjustable chair is to be positioned on a sloped ground surface 20, the upper frame 12 may be oriented at a suitable angle relative to the lower frame 14 such that the upper frame 12 and the seat 18 may be positioned substantially horizontally to provide a comfortable seating position for the user.

Figure 3:
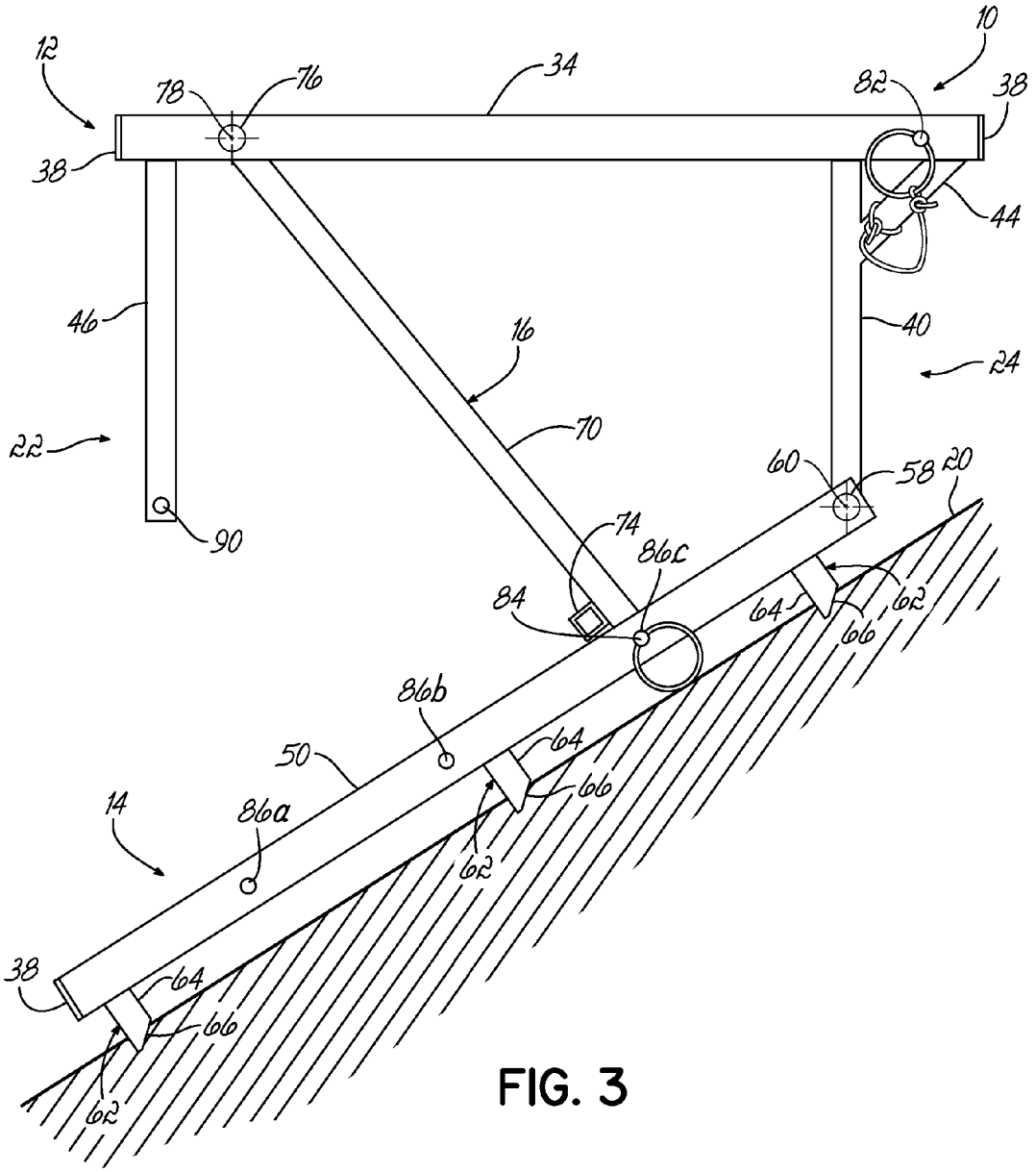
FIG. 3 is a left side view of the adjustable chair of FIG. 1, showing the adjustment mechanism in an exemplary second position.

FIG. 3 shows the adjustment brace 16 in an exemplary second position in which the adjustment brace 16 has been pivoted such that the brace apertures 80 are aligned with the rear-most set of lower frame apertures 86*c*, with a releasable coupling established therebetween using the lower retention pins 84. As shown, the upper frame 12 is angled relative to the lower frame 14 such that the adjustable chair 10 may be positioned on a sloped ground surface 20 while maintaining the upper frame 12 and the seat 18 in a substantially horizontal orientation. The angle defined between the upper frame 12 and lower frame 14 with the adjustment brace 16 provided in the exemplary second position shown in FIG. 3 may be approximately 33 degrees, for example. In the exemplary angled orientation shown in FIG. 3, a weight force exerted by a seated user is transferred from the seat 18 to the upper frame 12, and from the upper frame 12 to the lower frame 14 through the left side rear leg 40 and right side rear leg 42, and through the left brace arm 70 and right brace arm 72.

The adjustment brace 16 may be further pivoted about the brace pivot axis 78 as desired to releasably couple with the lower frame 14 at any of other sets of lower frame apertures 86*a*, 86*b*. In this manner, the upper frame 12 may be selectively oriented relative to the lower frame 14 to define unique corresponding angles therebetween for using the adjustable chair 10 on ground surfaces 20 having various degrees of slope. As the adjustment brace 16 is pivoted from the rear 24 of the adjustable chair 10 toward the front 22, the frame angle defined between the upper frame 12 and the lower frame 14 may progressively decrease. For example, coupling the adjustment brace 16 to the lower frame 14 at the rear-most lower frame apertures 86*c* yields a frame angle that may be greater than the frame angle corresponding to the middle set of lower frame apertures 86*b*, which may be greater than the frame angle corresponding to the front-most lower frame apertures 86*a*. Additionally, in the context of the illustrated embodiment, it will be understood that the maximum frame angle achievable between the upper frame 12 and the lower frame 14 is generally limited at least in part by the length of the left and right brace arms 70, 72.

As described above, the adjustable chair 10 may include any suitable quantity of sets of lower frame apertures formed at any suitable spacing on the lower frame 14, thereby providing the adjustable chair 10 with any desired quantity of brace positions for achieving any desired frame angle between the upper frame 12 and the lower frame 14. Furthermore, while retention pins and apertures are shown and described herein as being the features that enable releasable coupling of the adjustment brace 16 with the upper and lower frames 12, 14, any suitable alternative coupling mechanisms may be used.

Figure 4:
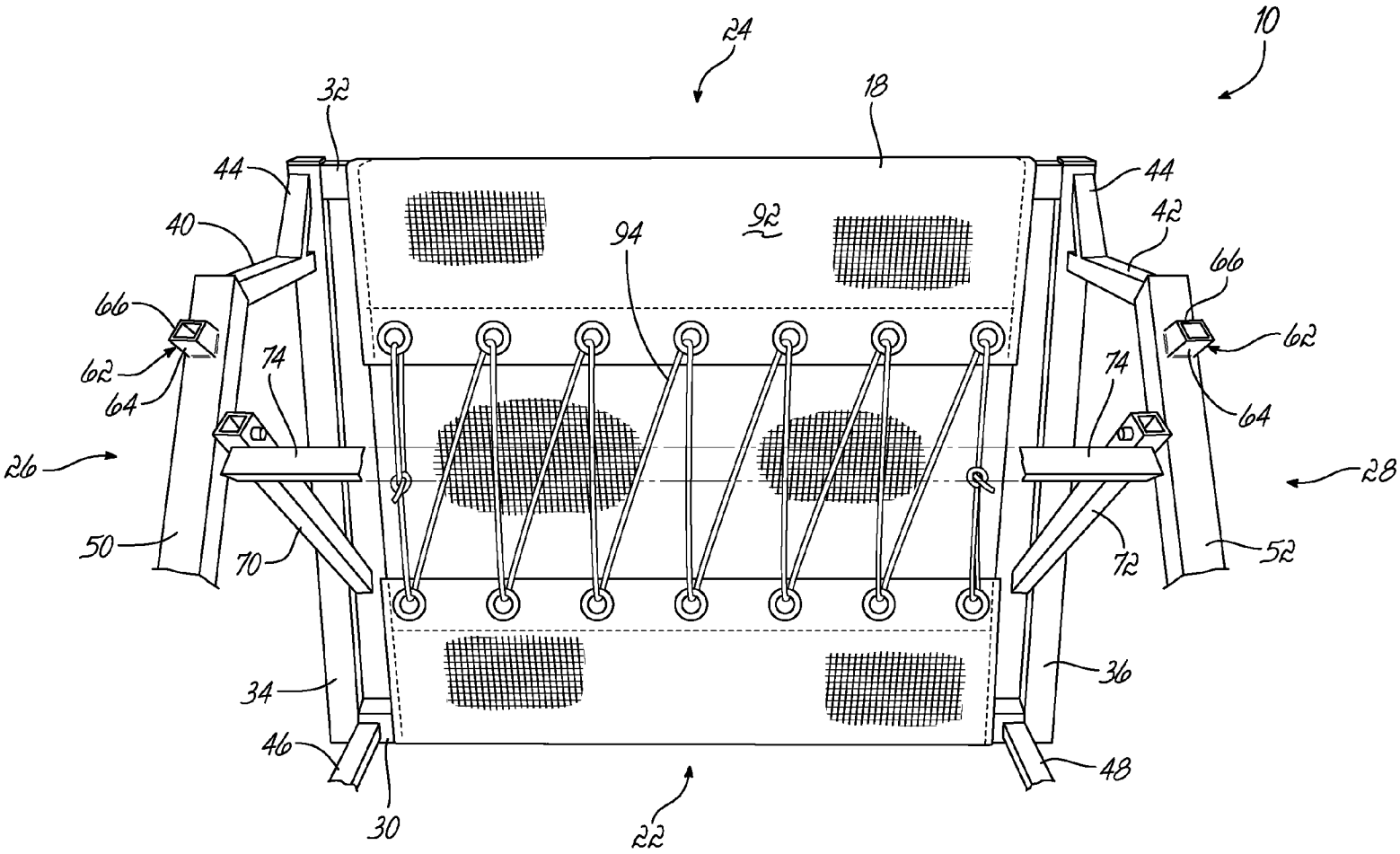
FIG. 4 is a partial perspective view of an underside of the adjustable chair of FIG. 1, showing details of a seat and the adjustment mechanism in the exemplary second position.

Referring to FIG. 4, an underside of the adjustable chair 10 is shown to illustrate exemplary features of the seat 18 carried by the upper frame 12. In the illustrated embodiment, the seat 18 includes a sheet-like body 92, which may be formed of a textile for example, that wraps partially around and extends between the front and rear upper frame members 30, 32. The ends of the sheet-like body 92 confront one another at the underside of the adjustable chair 10 and may be secured to one another with a cord 94 that weaves back and forth between the two confronting ends of the sheet-like body 92. In alternative embodiments, various other seat constructions may be used.

Referring to FIGS. 5-8, an adjustable chair 110 according to a second exemplary embodiment of the invention is shown. It will be understood that the adjustable chair 110 is generally similar in structure and function to the adjustable chair 10, except as otherwise described below. In that regard, similar reference numerals refer to similar features shown and described in connection with FIGS. 1-4.

The adjustable chair 110 may be similar in length and width to the adjustable chair 10 though generally smaller in height. Advantageously, the adjustable chair 110 may present a structure that is generally smaller in profile and lower in weight than the adjustable chair 10, thereby providing improved portability and ease of storage and operation. Additionally, the adjustable chair 110 may be well-suited for use on ground surfaces 20 having a maximum slope that is less than those on which the adjustable chair 10 may be used.

The adjustable chair 110 generally includes an upper frame 112, a lower frame 114, and an adjustment mechanism shown in the form of a left adjustment arm 116*a* and a right adjustment arm 116*b*. The lower frame 114 includes a left side lower frame member 150 and an opposed right side lower frame member 152, arranged generally parallel to one another. Each of the lower frame members 150, 152 includes a plurality of lower frame apertures, which is aligned with the corresponding plurality of apertures provided on the opposed lower frame member 150, 152. In the embodiment shown, the lower frame members 150, 152 include six sets of lower frame apertures 186*a*, 186*b*, 186*c*, 186*d*, 186*e*, 186*f*, which define six total positions in which the adjustment brace 16 may be releasably coupled to the lower frame 114.

Figure 6:
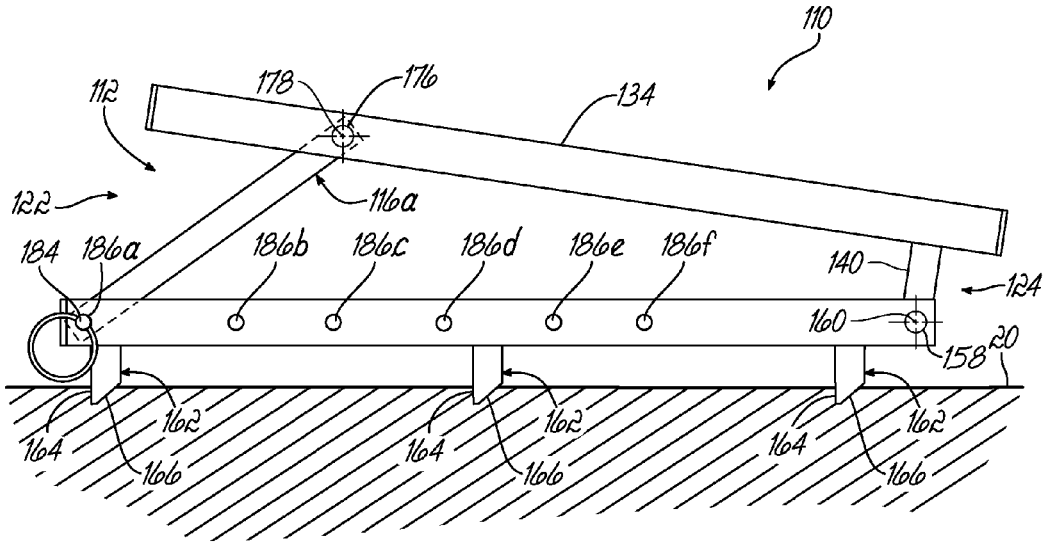
FIG. 6 is a left side view of the adjustable chair of FIG. 5, showing an adjustment mechanism of the chair in an exemplary first position.
Figure 7:
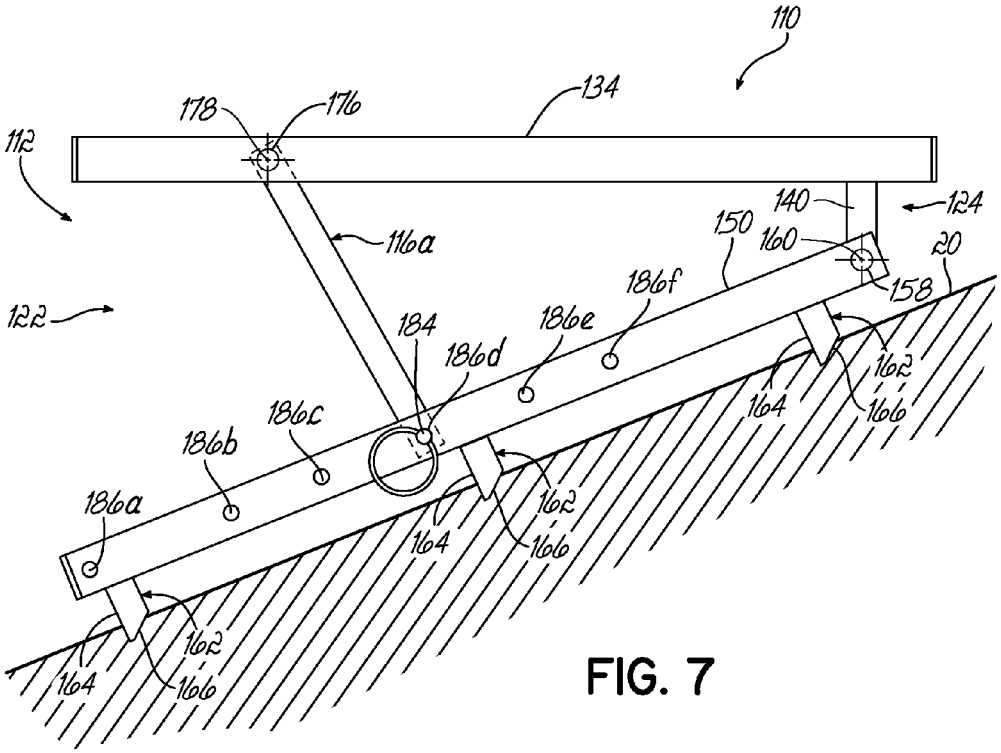
FIG. 7 is a left side view of the adjustable chair of FIG. 5, showing the adjustment mechanism in an exemplary second position.

As shown best in FIGS. 6 and 7, the front-most set of lower frame apertures 186*a* may be positioned at the front ends of the lower frame members 150, 152. The remaining sets of lower frame apertures 186*b*, 186*c*, 186*d*, 186*e*, 186*f* may be spaced from the front-most set 186*a* by a first distance, and may be interspaced by one or more distances that are generally less than the first distance. In alternative embodiments, any suitable quantity and spacing of lower frame apertures may be provided.

The left and right adjustment arms 116*a*, 116*b* are pivotably coupled at their upper ends to the left side upper frame member 134 and right side upper frame member 136, respectively, at locations proximate the front ends of the upper frame members 134, 136. The opposed lower ends of the left and right adjustment arms 116*a*, 116*b* are releasably couplable to the lower frame 114 in a plurality of positions, defined by the various sets of lower frame apertures 186*a*, 186*b*, 186*c*, 186*d*, 186*e*, 186*f* for securing the upper frame 112 in a corresponding plurality of angled orientations relative to the lower frame 114. The left and right adjustment arms 116*a*, 116*b* are generally equal in length and may be longer than the left side and right side rear legs 140, 142 of the upper frame 112, thereby enabling the plurality of angled orientations.

FIG. 6 shows the adjustment arms 116*a*, 116*b* in an exemplary first position in which the adjustment arms 116*a*, 116*b* are releasably coupled to the lower frame 114 at the front-most set of lower frame apertures 186*a*. In this exemplary first position, the upper frame 112 is slightly positively angled relative to the lower frame 114, which may be suitable for use on a horizontal or slightly sloped ground surface 20.

FIG. 7 shows the adjustment arms 116*a*, 116*b* in an exemplary second position in which the adjustment arms 116*a*, 116*b* are releasably coupled to the lower frame 114 at intermediate lower frame apertures 186*d*. In this exemplary second position, the upper frame 112 is positively angled relative to the lower frame 114 with a frame angle that is greater than the frame angle corresponding to the front-most lower frame apertures 186*a*, as shown in FIG. 6. The exemplary angled orientation shown in FIG. 7 may be suitable for use on a sloped ground surface 20.

In one embodiment, the sets of lower frame apertures 186*a*, 186*b*, 186*c*, 186*d*, 186*e*, 186*f* may be positioned on the lower frame members 150, 152 and spaced relative to one another such that the frame angle defined between the upper frame 112 and the lower frame 114 progressively increases as the adjustment arms 116*a*, 116*b* are pivoted from the front-most set of lower frame apertures 186*a* toward the rear-most set of lower frame apertures 186*f*. In another embodiment, the sets of lower frame apertures 186*a*, 186*b*, 186*c*, 186*d*, 186*e*, 186*f* may be positioned and spaced relative to one another such that the frame angle progressively increases as the adjustment arms 116*a*, 116*b* are pivoted from the front-most set of lower frame apertures 186*a* toward an intermediate set of lower frame apertures (e.g., apertures 186*d*), and then progressively decreases from the intermediate set of lower frame apertures toward the rear-most set of lower frame apertures 186*f*.

Figure 5:
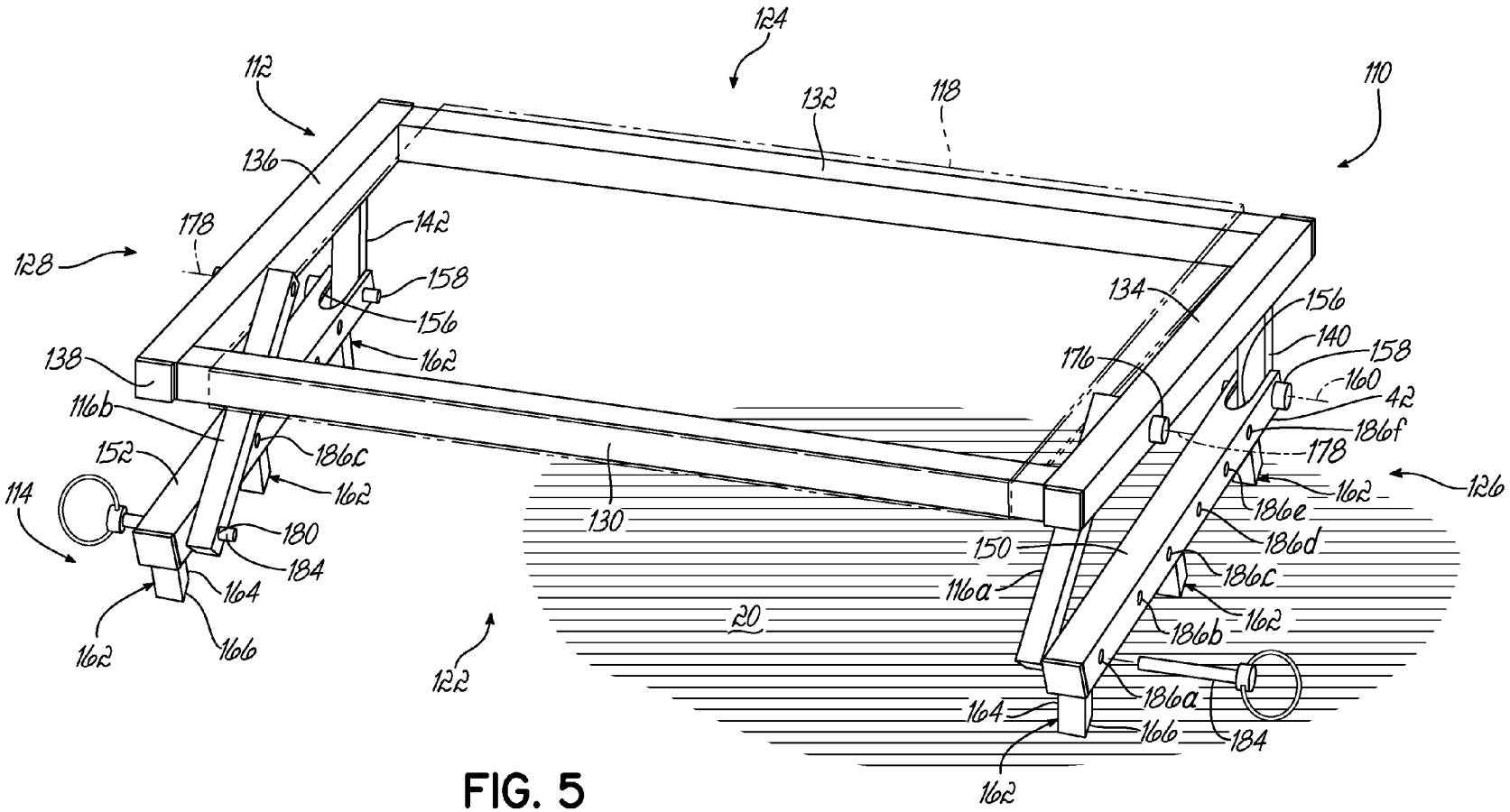
FIG. 5 is a front perspective view of an exemplary second embodiment of an adjustable chair in accordance with the principles of the invention.

It will be appreciated that the general positioning and spacing of the lower frame apertures 186*a*, 186*b*, 186*c*, 186*d*, 186*e*, 186*f* shown in FIGS. 5-7 is for exemplary purposes only and does not limit the adjustable chair 110 to either one of the functional embodiments described above. It will be further appreciated that the same also applies for the adjustment chair 10 and its lower frame apertures 86*a*, 86*b*, 86*c* shown and described in connection with FIGS. 1-4.

While the present invention has been illustrated by the description of embodiments thereof, and while the embodiments have been described in considerable detail, it is not intended to restrict or in any way limit the scope of the appended claims to such detail. It will be appreciated that the various features shown and described herein may be used alone or in any combination. Additional advantages and modifications will readily appear to those skilled in the art. The invention in its broader aspects is, therefore, not limited to the specific details, representative apparatus and method, and illustrative examples shown and described. Accordingly, departures may be made from such details without departing from the scope of the general inventive concept.

What is claimed is:

1. An adjustable chair, comprising:

an upper frame configured to carry a seat;

a lower frame pivotably coupled with the upper frame and configured to support the upper frame above a ground surface; and an adjustment mechanism selectively movable between a plurality of positions for securing the upper frame relative to the lower frame in a corresponding plurality of orientations;

wherein the upper frame includes first and second downwardly depending legs, the first and second downwardly depending legs being pivotably coupled to the lower frame.

2. The adjustable chair of claim 1, wherein the adjustment mechanism is pivotably coupled to the upper frame.

3. The adjustable chair of claim 1, wherein the adjustment mechanism is selectively movable between a first position in which the upper frame is secured in a first orientation relative to the lower frame, and at least one second position in which the upper frame is secured in an angled second orientation relative to the lower frame.

4. The adjustable chair of claim 3, wherein the adjustment mechanism is selectively movable to a third position, between the first position and the at least one second position, in which the upper frame is secured in an angled third orientation relative to the lower frame.

5. The adjustable chair of claim 1, wherein the adjustment mechanism includes first and second arms pivotably coupled to the upper frame.

6. The adjustable chair of claim 5, wherein the first and second arms are coupled to one another with a cross-member.

7. The adjustable chair of claim 1, wherein the upper frame further includes third and fourth downwardly depending legs, the third and fourth downwardly depending legs being coupleable to the lower frame for securing the upper frame in a parallel orientation relative to the lower frame.

8. The adjustable chair of claim 1, further comprising:

at least one spike member extending downwardly from the lower frame and adapted to engage the ground surface for releasably anchoring the adjustable chair to the ground surface.

9. The adjustable chair of claim 8, wherein the lower frame includes first and second lower frame members arranged generally parallel to one another, and the at least one spike member extends downwardly from at least one of the first lower frame member or the second lower frame member.

10. The adjustment chair of claim 1, wherein the upper frame includes first and second upper frame members arranged generally parallel to one another.

11. The adjustable chair of claim 1, further comprising:

at least one retention member for releasably coupling the adjustment mechanism to the lower frame.

12. The adjustable chair of claim 11, wherein the at least one retention member includes a pin and the lower frame includes a plurality of apertures adapted to receive the pin for coupling the adjustment mechanism to the lower frame in at least a portion of the plurality of positions.

13. The adjustable chair of claim 1, further comprising:

a seat carried by the upper frame.

14. A method of adjusting an adjustable chair including a first chair portion carrying a seat and a second chair portion, the method comprising:

providing the first chair portion and the seat in a first orientation relative to the second chair portion, the first chair portion having first and second downwardly depending legs pivotably coupled to the second chair portion; and pivoting the first chair portion about a first pivot axis, including pivoting the first and second downwardly depending legs relative to the second frame portion, to provide the first chair portion and the seat in a second orientation relative to the second chair portion.

15. The method of claim 14, wherein the adjustable chair further includes an adjustment mechanism, and wherein providing the first chair portion and the seat in the first orientation includes providing the adjustment mechanism in a first position, and providing the first chair portion and the seat in the second orientation includes providing the adjustment mechanism in a second position.

16. The method of claim 15, wherein moving the adjustment mechanism between the first position and the second position includes pivoting the adjustment mechanism about a second pivot axis.

17. The method of claim 14, wherein providing the first chair portion and the seat in the second orientation includes providing the first chair portion and the seat in an angled orientation relative to the second chair portion.

18. The method of claim 14, wherein the first chair portion includes an upper frame and the second chair portion includes a lower frame pivotably coupled with the upper frame, and pivoting the first chair portion about the first pivot axis includes pivoting the upper frame relative to the lower frame about a substantially horizontal pivot axis.

19. The method of claim 14, further comprising:

pivoting the first chair portion about the first pivot axis to provide the first chair portion and the seat in a third orientation relative to the second chair portion.

20. An adjustable chair, comprising:

an upper frame configured to carry a seat;

a lower frame pivotably coupled with the upper frame and configured to support the upper frame above a sloped ground surface, the lower frame configured to frictionally engage the sloped ground surface; and an adjustment mechanism selectively movable between a plurality of positions relative to the upper frame and the lower frame, each position defining a corresponding frame angle between the upper frame and the lower frame that orients the lower frame in alignment with a sloped ground surface having a slope angle that generally corresponds to the frame angle while presenting the upper frame in a generally horizontal orientation.

21. The adjustable chair of claim 20, wherein the adjustment mechanism includes a first end pivotably coupled to one of the upper frame or the lower frame, and a second end releasably couplable to the other of the upper frame or the lower frame at a plurality of positions along a length thereof for securing the upper frame relative to the lower frame in a corresponding plurality of orientations.

* * * * *